US006402485B2

(12) United States Patent
Hong et al.

(10) Patent No.: US 6,402,485 B2
(45) Date of Patent: Jun. 11, 2002

(54) COMPRESSOR

(75) Inventors: Sang Wook Hong; Ho Seon Rew, both of Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/732,900

(22) Filed: Dec. 11, 2000

(30) Foreign Application Priority Data

Jan. 4, 2000 (KR) ..... 00-179

(51) Int. Cl.[7] ..... F04B 17/00
(52) U.S. Cl. ..... 417/366
(58) Field of Search ..... 417/366, 410.5; 418/55.1, 55.2

(56) References Cited

U.S. PATENT DOCUMENTS 5,055,010 A * 10/1991 Logan ..... 417/410
5,064,356 A * 11/1991 Horn ..... 417/410
5,240,391 A * 8/1993 Ramshankar et al. ... 417/410 R
5,286,179 A * 2/1994 Forni et al. ..... 418/55.1
5,342,183 A * 8/1994 Rafalovich et al. ..... 418/15
5,366,352 A * 11/1994 Deblois et al. ..... 417/292
5,745,992 A * 5/1998 Caillat et al. ..... 29/888.022
6,186,753 B1 * 2/2001 Hugenroth et al. ..... 418/55.1

* cited by examiner

*Primary Examiner*—Charles G. Freay
*Assistant Examiner*—Han L Liu
(74) *Attorney, Agent, or Firm*—Birch, Stewart, Kolasch & Birch, LLP

(57) ABSTRACT

Scroll compressor including a shell having an inlet tube for drawing a refrigerant, and an outlet tube for discharging the compressed refrigerant, a compressor part arranged in an upper portion of the shell having an inlet hole for drawing refrigerant flowed through the inlet tube for compressing the refrigerant flowed through the inlet hole, a motor part arranged in a lower portion of the shell for transmission of a driving force for operating the compressor part, and a main frame having an edge arranged adjoined to a baffle, which baffle is provided for splitting the refrigerant flowed into the shell through the inlet tube into a flow for the compressor part and a flow for the motor part, and which edge has a curved guide surface extended to the inlet hole of the compressor part for forming a refrigerant flow passage together with the baffle, thereby improving performance of the compressor by preventing additional pressure loss and temperature rise.

1 Claim, 4 Drawing Sheets

COMPRESSOR

BACKGROUND OF THE INVENTION

1. Field of the Invention

The present invention relates to a scroll compressor, and more particularly, to a refrigerant inlet of the scroll compressor.

2. Background of the Related Art

In general, the scroll compressor is used for compressing a gas by means of one pair of opposite scrolls, and employed mostly in a room air conditioner or a car for compressing a refrigerant gas owing to a high efficiency, low noise, small size and light weight.

Referring to FIG. 1, a related art scroll compressor is provided with a compressor part 10 for compressing a refrigerant gas drawn into a shell 1 from an evaporator(not shown) in a cooling cycle through an inlet tube 1*a*, and a motor part 20 for transmission of a driving force to the compressor part 10 to compress the refrigerant. The shell 1 encloses the compressor part 10 and the motor part 20 for preventing leakage of the refrigerant during the compression. There is a main frame 30 supports the compressor part 10 for stable power transmission from the motor part 20 to the compressor part 10. The compressor part 10 has a stationary scroll 11 fixed to an upper portion of inside of the shell 1, and a rotating scroll 12 engaged with the stationary scroll 11 for being rotated by a driving force received from the motor part 20. The rotating scroll 12 is rotatably mounted on the main frame 30, and the stationary scroll 11 is fixed to the main frame 30 on the rotating scroll 12. The stationary scroll 11 and the rotating scroll 12 have laps 11*a* and 12*a* of involute curve projected in a vertical direction, and for forming a compression chamber 13 in the compressor part 10. And, there is an inlet 40 for communication between an inner space of the shell 1 and the compression chamber 13 in the scrolls 11 and 12 for compression of the refrigerant. The motor part 20 has rotor 21/stator 22 for generating a driving power from an external power source, i.e., a motor and a rotating shaft 50. The rotating shaft 50 is fitted to an inside of the rotor 21 and the rotating scroll 12 on a top end thereof, for transmission of the driving force generated at the rotor 21/stator 22 to the rotating scroll 12 through the shaft 50. In the meantime, there is a discharge chamber 14 at a central portion of atop of the compressor part 10 in communication with the compression chamber 13, and the discharge chamber 14 is in turn in communication with an outlet tube 1*b* for discharging compressed refrigerant to a condenser(not shown). And, the inlet tube 1*a* is positioned at one side of the shell 1 for receiving the refrigerant from the evaporator(not shown), and there is a baffle 60 on a discharge side of the inlet tube 1*a* for deflecting flow of the refrigerant. In the operation of the compressor, the refrigerant enters into the shell 1 through the inlet tube 1*a* and split in upper and lower directions at the baffle 60. The refrigerant in the lower direction cools down the motor part 20 as the refrigerant flows through an inner portion of the shell 1, and flows upward to enter into the compression chamber 13 through the inlet 40, finally. On the other hand, the split refrigerant in the upper direction flows upward to an upper portion of the shell 1, and turns back to enter into the compression chamber 13 through the inlet 40 opened substantially at a right angle to a direction of the upward refrigerant flow. Though there is a temperature rise caused by a heat from the motor part 20 and a pressure loss caused by the split flow, the system and operation of the related art compressor is essential for an effective prevention of overheating of the motor part 20 by using the refrigerant without provision of any additional cooling device. In fact, however, there is additional pressure loss and temperature rise in the operation of the compressor other than what is just explained, which will be explained, in detail.

Referring to FIG. 2, a related art refrigerant flow structure up to the compression chamber has a flow passage formed continuously inclusive of the baffle 60 and an edge of the main frame 30 adjoining to the baffle 60, and an inlet hole 40 formed adjacent to the main frame 30. An axis of the inlet hole 40 is perpendicular to the flow passage, and the inlet hole 40 is positioned on an inner side of an edge of the main frame 30. Therefore, the refrigerant in the upper direction is involved in a flow separation during the refrigerant passes through the flow passage, to pass by the inlet hole 40 and flow to the upper portion of the shell 1.

This refrigerant flow can be explained clearly with reference to FIG. 3. The refrigerant entered into the shell 1 through the inlet tube 1*a* passes by the inlet hole 40 owing to a geometry of the flow structure explained before in a process the refrigerant flows in a vertical direction guided by the baffle 60 and the main frame 30. Accordingly, the refrigerant flow to the inlet hole 40 is not smooth, but enters into the compression chamber 13 formed by respective scrolls 11 and 12 through the inlet hole 40 after the refrigerant flows to the upper portion of the shell 1. Consequently, there is collision of the refrigerant flow passing by the inlet 40 and rising upward and the refrigerant flow heated in the process flowing around the motor, to cause a turbulent flow, that causes an additional pressure loss. And, the refrigerant absorbs heat from the main frame 30 in an extended flow path, to cause an additional temperature rise. At the end, since the additional pressure loss and the additional temperature rise interfere a smooth entrance of the refrigerant into the inlet hole 40, resulting in overheating of the refrigerant, an overall compression efficiency of the compressor is deteriorated.

SUMMARY OF THE INVENTION

Accordingly, the present invention is directed to a compressor that substantially obviates one or more of the problems due to limitations and disadvantages of the related art.

An object of the present invention is to provide a compressor which can minimize a pressure loss and a temperature rise of a refrigerant while various components of the compressor are cooled down smoothly.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the Scroll compressor including a shell having an inlet tube for drawing a refrigerant, and an outlet tube for discharging the compressed refrigerant, a compressor part arranged in an upper portion of the shell having an inlet hole for drawing refrigerant flowed through the inlet tube for compressing the refrigerant flowed through the inlet hole, a motor part arranged in a lower portion of the shell for transmission of a driving force for operating the compressor part, and a main frame having an edge arranged adjoined to a baffle, which baffle is provided for splitting the refrigerant flowed into the shell through the inlet tube into a flow for the compressor part and a flow for the motor part, and which edge has a curved guide surface extended to the inlet hole of the compressor part for forming a refrigerant flow passage together with the baffle, thereby improving performance of the compressor by preventing additional pressure loss and temperature rise.

The guide surface preferably has a radius of curvature set to be equal to a distance from the edge of the main frame to the inlet hole.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
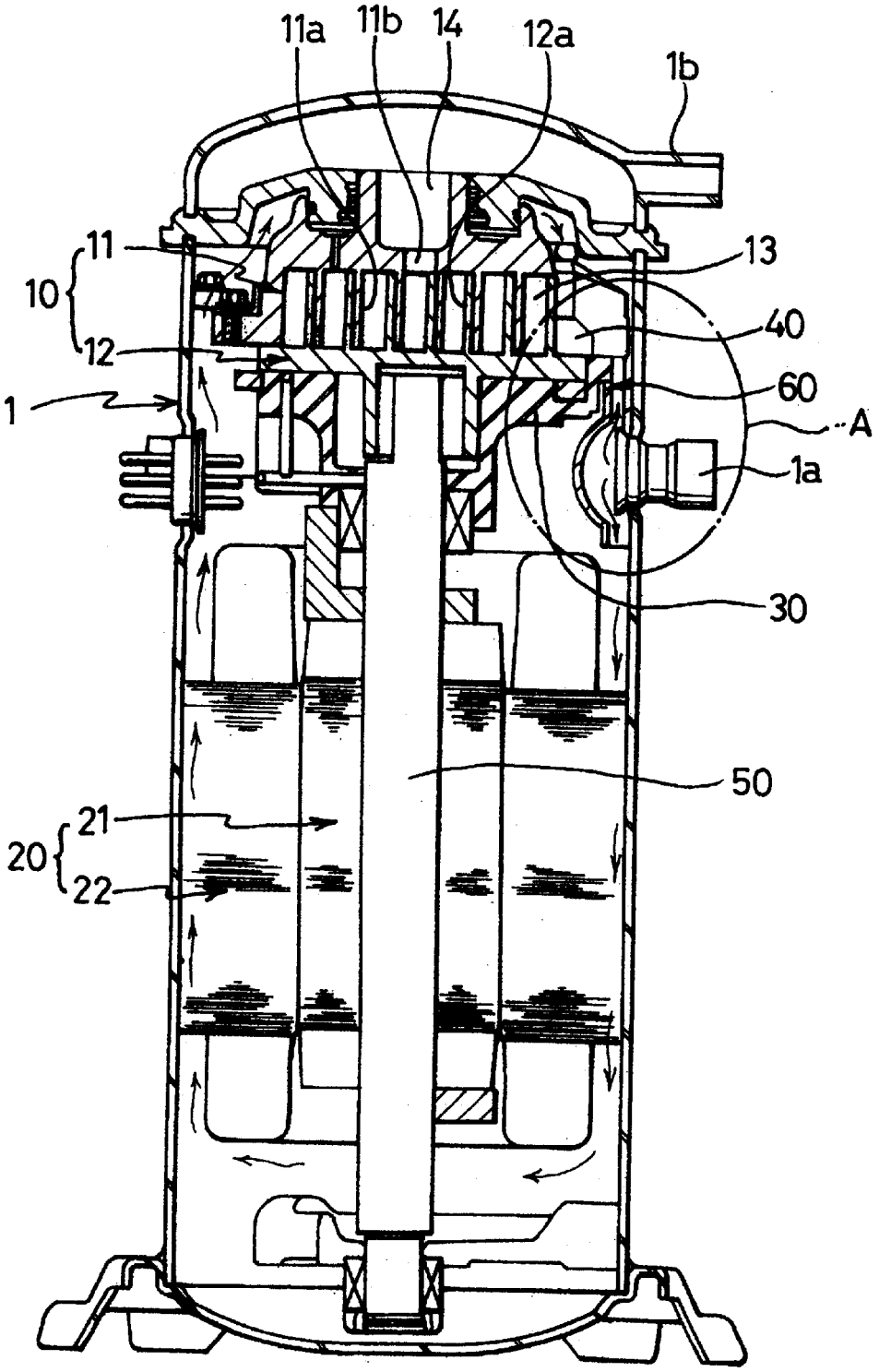
FIG. 1 illustrates a longitudinal section of a related art scroll compressor.
Figure 2:
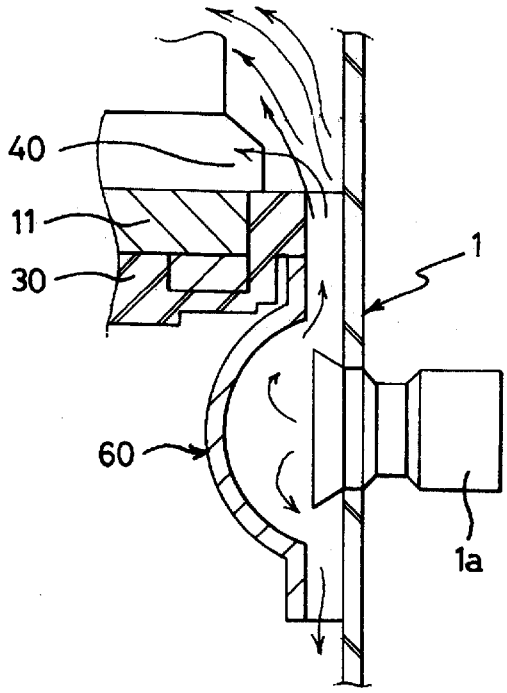
FIG. 2 illustrates an enlarged view of "A" part in FIG. 1.
Figure 3:
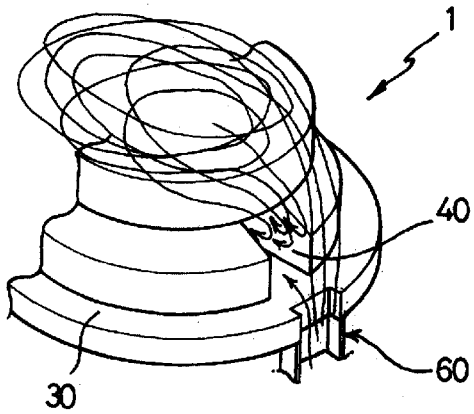
FIG. 3 illustrates a refrigerant flow around an inlet of a related art scroll compressor, schematically.
Figure 4:
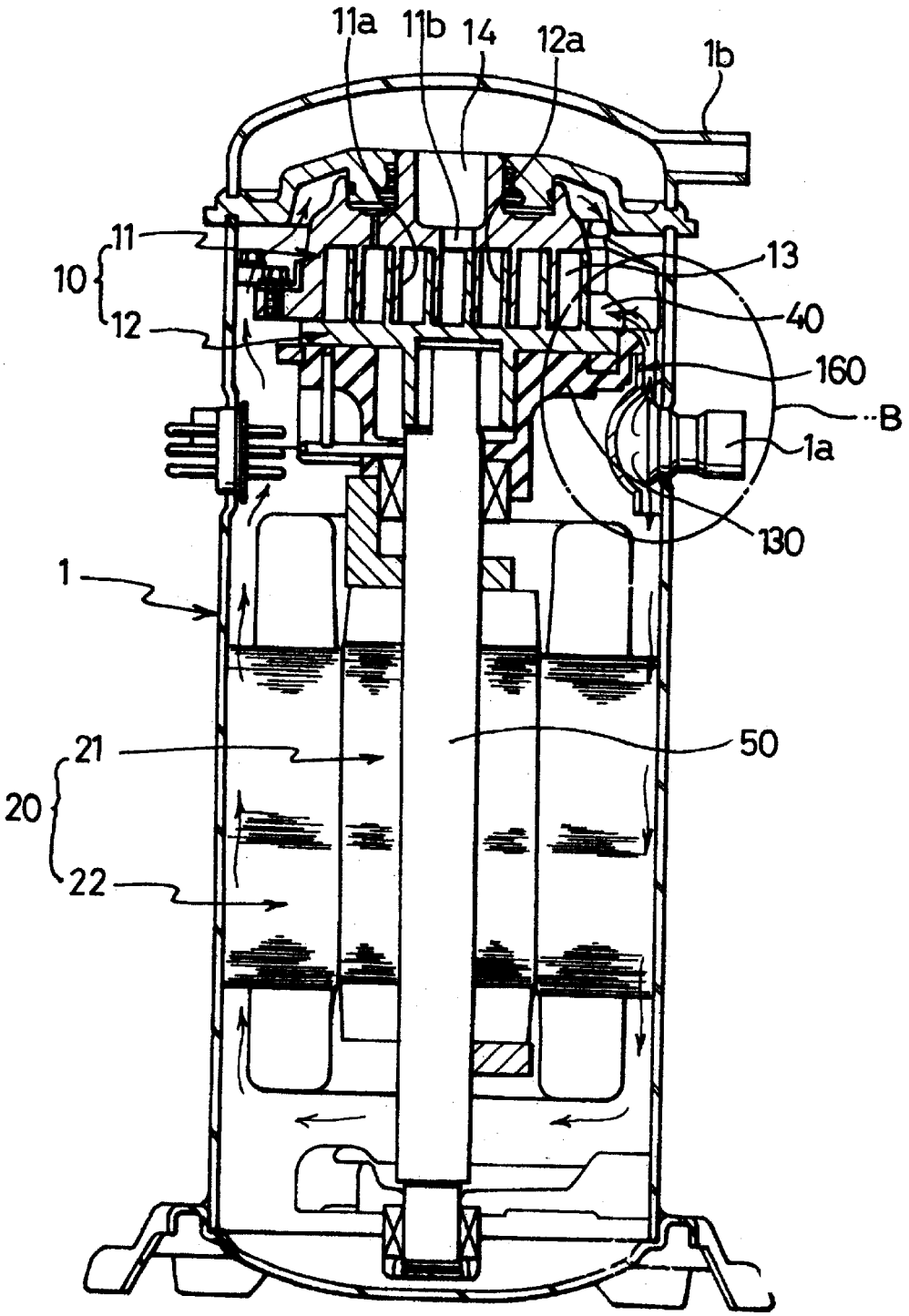
FIG. 4 illustrates a longitudinal section of a scroll compressor in accordance with a preferred embodiment of the present invention.

Reference will now be made in detail to the preferred embodiments of the present invention, examples of which are illustrated in the accompanying drawings. In explanations of the present invention, identical components will be given the same names and reference symbols, and explanations of which will be omitted. FIG. 4 illustrates a longitudinal section of a scroll compressor in accordance with a preferred embodiment of the present invention, and FIG. 5 illustrates an enlarged view of "B" part in FIG. 4.

Referring to FIG. 4, the scroll compressor in accordance with a preferred embodiment of the present invention includes a compressor part 10 for compressing a refrigerant gas, a motor part 20 for transmission of a driving force to the compressor part 10, a shell 1 for accommodating the compressor part 10 and the motor part 20, and a main frame 130 for supporting the compressor part 10. Since systems other than above are the same with the related art compressor, detailed explanation of which will be omitted.

Figure 5:
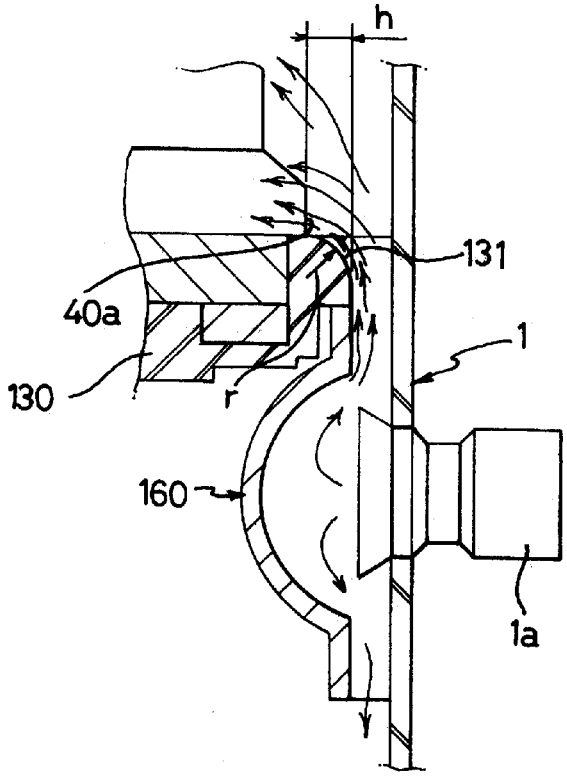
FIG. 5 illustrates an enlarged view of "B" part in FIG. 4.

In the meantime, referring to FIG. 5, there is a flow passage structure of the compressor of the present invention including a flow passage formed continuously inclusive of a baffle 160 and an edge of the main frame 130 adjoining to the baffle 160, and an inlet hole 40*a* formed adjacent to the edge of the main frame 130. In the flow passage structure of the present invention, the edge of the main frame 130 is provided with a curved guide surface 131. That is, the edge of the main frame 130 is curved surface continuous to the inlet hole 40*a*, so that the upward refrigerant deflected at the baffle 160 flows guided by the guide surface 131 until the refrigerant enters into the inlet hole 40, directly. In this instance, it is preferable that a radius of curvature 'r' of the curved surface, i.e., the guided surface 131, of the main frame 103 is set to be a distance 'h' from the edge of the main frame 130 to the inlet hole 40*a* substantially, for minimizing the separation of the refrigerant flow.

The operation of the compressor of the present invention will be explained with reference to FIGS. 4~6.

The refrigerant entered into the shell 1 through the inlet tube 1*a* via the evaporator(not shown) flows into respective compression chambers 13 between respective scrolls 11 and 12 through the inlet hole 40*a* in communication with the scrolls 11 and 12. In this state, the rotating scroll 12 is rotated according to rotation of the rotating shaft 50 coupled to the rotating scroll 12, and the laps 11*a* and 12*a* on respective scrolls 11 and 12, maintaining a close contact, compresses the refrigerant in an inside of the scrolls 11 and 12. The compressed refrigerant is discharged to the discharge chamber 14 through an outlet hole 11*b* in the stationary scroll 11, and therefrom to the condenser(not shown) through an outlet tube 1*b*. Then, the compressed refrigerant is supplied to the condenser as the foregoing suction, compression and discharge processes are repeated in a sequence.

Figure 6:
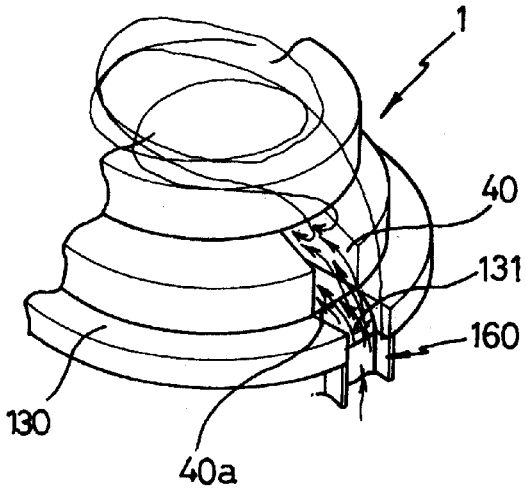
FIG. 6 illustrates a refrigerant flow around an inlet of the scroll compressor of the present invention, schematically.

In this instance, as shown in FIG. 6, the refrigerant entered into the shell 1 through the inlet tube 1*a* is split into an upward refrigerant flow and a downward refrigerant flow, wherein the upward refrigerant flow proceeds along the guide surface 131 and enters into the inlet hole 40*a*, directly. This is because liquid has a nature to flow along a wall, particularly, adhered to a curved surface, i.e., the coanda effect. The present invention utilizes the coanda effect for improving a refrigerant flow passage structure.

Thus, the upward refrigerant flow split at the baffle 160 flows along the guide surface 131 and enters into the inlet hole 40*a* directly, i.e., the upward refrigerant flow passing by the inlet hole 40 is reduced sharply, and the unnecessary upward refrigerant flow to the upper portion of the shell 1 is prevented. Moreover, the smooth upward refrigerant flow permits a smooth downward refrigerant flow back into the inlet hole 40 without interference after cooling the motor. And, the smooth and direct refrigerant flow into the inlet hole 40*a* permits to prevent the additional absorption of heat from the main frame 130. The table shown below is a result of an analysis of the refrigerant flow obtained according to the present invention.

| | The Related Art | The Present Invention |
|---|---|---|
| $\Delta T$(° C.) | 13.8 | 10.8 |
| $\Delta P_{loss}$(Pa) | 288 | 69.8 |

Where, $\Delta T$ denotes a temperature difference of the refrigerant entered into the shell 1, and $\Delta P_{loss}$ denotes a pressure loss of the refrigerant flowing through the shell 1. That is, as can be known from the table 1, in comparison to the related art main frame 30, the main frame 130 of the present invention can reduce an overall pressure loss by approx. 75%, and the refrigerant temperature difference by approx. 3° C. Such reduction of pressure loss and temperature rise improves an overall volumetric efficiency of the compressor by approx. one %, resulting to provide an improved compression performance, actually.

As has been explained, the compressor of the present invention has the following advantages.

The formation of a curved guide surface at an edge of the main frame permits a smooth refrigerant flow into an inlet, and to reduce absorption of a heat from the main frame. Prevention of such additional pressure loss and temperature rise of the refrigerant permits to minimize the pressure loss and the temperature rise of the refrigerant even though components of the compressor are cooled adequately, thereby improving a performance of the compressor.

It will be apparent to those skilled in the art that various modifications and variations can be made in the compressor of the present invention without departing from the spirit or scope of the invention. Thus, it is intended that the present invention cover the modifications and variations of this invention provided they come within the scope of the appended claims and their equivalents.

What is claimed is:

1. A compressor comprising:

a shell having an inlet tube for drawing a refrigerant, and an outlet tube for discharging the compressed refrigerant;

a compressor part arranged in an upper portion of the shell having an inlet hole for drawing refrigerant flowed through the inlet tube for compressing the refrigerant flowed through the inlet hole;

a motor part arranged in a lower portion of the shell for transmission of a driving force for operating the compressor part; and, a main frame having an edge arranged adjoined to a baffle, the baffle provided for splitting the refrigerant flowed into the shell through the inlet tube into a flow for the compressor part and a flow for the motor part, and the edge having a curved guide surface extended to the inlet hole of the compressor part for forming a refrigerant flow passage together with the baffle, wherein the guide surface has a radius of curvature set ti be equal to a distance from the edge of the main frame to the inlet hole.

* * * * *